United States Patent [19]

Nishikawa

[11] Patent Number: 4,562,720

[45] Date of Patent: Jan. 7, 1986

[54] IRONING APPARATUS

[75] Inventor: Hirotaka Nishikawa, Sagamihara, Japan

[73] Assignee: Toyo Seikan Kaisha, Limited, Tokyo, Japan

[21] Appl. No.: 658,848

[22] Filed: Oct. 9, 1984

[30] Foreign Application Priority Data

Mar. 2, 1984 [JP] Japan ..... 59-38645

[51] Int. Cl.[4] ..... B21D 22/00

[52] U.S. Cl. ..... 72/349

[58] Field of Search ..... 72/347, 348, 349

[56] References Cited

U.S. PATENT DOCUMENTS 1,962,510 6/1934 Kellogg ..... 72/349

4,205,546 6/1980 Lugosse ..... 72/347

*Primary Examiner*—Leon Gilden

*Attorney, Agent, or Firm*—Armstrong, Nikaido, Marmelstein & Kubovcik

[57] ABSTRACT

An ironing apparatus for forming a cup-like metallic article such as an one-piece metallic can body is provided. The apparatus comprises a punch provided on a tip of a ram adapted to reciprocate in the horizontal direction and a plurality of ring dies cooperating with the punch. In the apparatus, the punch reciprocates such that the center of the end face thereof moves along a locus curved downwardly with the gravity, and the die is disposed to be slightly inclined with respect to a vertical plane such that the axis of the die extends substantially in the tangential direction of the locus at the location of the die.

2 Claims, 7 Drawing Figures

IRONING APPARATUS

BACKGROUND OF THE INVENTION

The present invention relates to an ironing apparatus and more particularly, to such an ironing apparatus which may form a cup-like article such as an one-piece metallic can body without causing uneven thickness in the circumferential direction of the sidewall portion thereof.

In an ironing apparatus for forming a redrawn-ironed metallic can body to be used for beer cans, carbonated drinks cans and the like, a ram having a punch on the tip thereof is usually adapted to reciprocate in the horizontal direction. The ram is usually elongated, e.g. 50 mm in diameter and 1.35 m long, and thus curves downwardly with gravity during its reciprocal movement (refer to FIG. 5).

Conventionally a ring die 2 cooperating with the punch for forming an ironed metallic can body is disposed vertically, e.g. such that the axis 2x thereof extends in the horizontal direction, as shown in FIG. 1. Consequently, even if the die 2 is radially aligned with the punch 1 such that the axes thereof virtually coincide with each other at the location of the die 2, and an entry portion 3*a* of the sidewall portion 3 of the can body under forming has a uniform thickness in the circumferential direction, an exit portion 3*b* of the sidewall portion 3 which is formed with the punch 1 moving in the arrow direction A, e.g. slightly downwardly, tends to have uneven circumferential thickness such that an upper portion $3b_1$ thereof be somewhat thicker than a lower portion $3b_2$.

Since the sidewall portion of an ironed metallic can body is usually very thin, e.g. 0.10 to 0.15 mm thick, the aforementioned uneven circumferential thickness is apt to damage the appearance of the can body due to ruggedness of the sidewall portion caused by the difference of reduction in the circumferential direction, and incur troubles such as the decrease of strength or rupture at an especially thin portion such as the lower portion $3b_2$ of the formed sidewall portion.

SUMMARY OF THE INVENTION

It is an object of the invention to provide an ironing apparatus which may form a cup-like article without causing uneven thickness in the circumferential direction of the sidewall portion thereof.

According to the invention there is provided an ironing apparatus for forming a cup-like metallic article such as an one-piece metallic can body comprising a punch provided on a tip of a ram adapted to reciprocate in the horizontal direction and a plurality of ring dies cooperating with the punch, in which the punch reciprocates such that the center of the end face thereof moves along a locus curved downwardly with the gravity, and the die is disposed to be slightly inclined with respect to a vertical plane such that the axis of the die extends substantially in the tangential direction of the locus at the location of the die.

Other objects and advantages of the invention will be apparent from the following description and the accompanying drawings.

DETAILED DESCRIPTION OF THE PREFERRED EMBODIMENT

Figure 2:
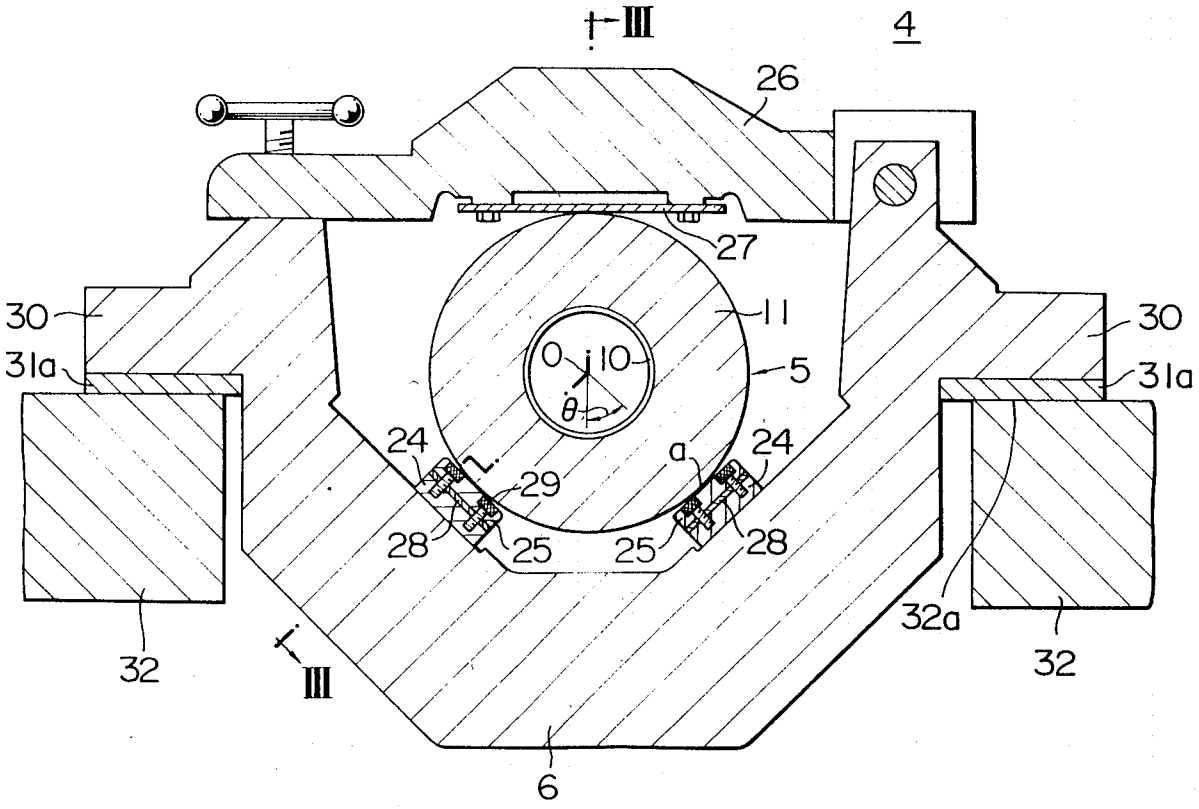
FIG. 2 is a vertical, sectional view taken along line II—II of FIG. 3, of an embodiment of the ironing apparatus according to the invention.
Figure 3:
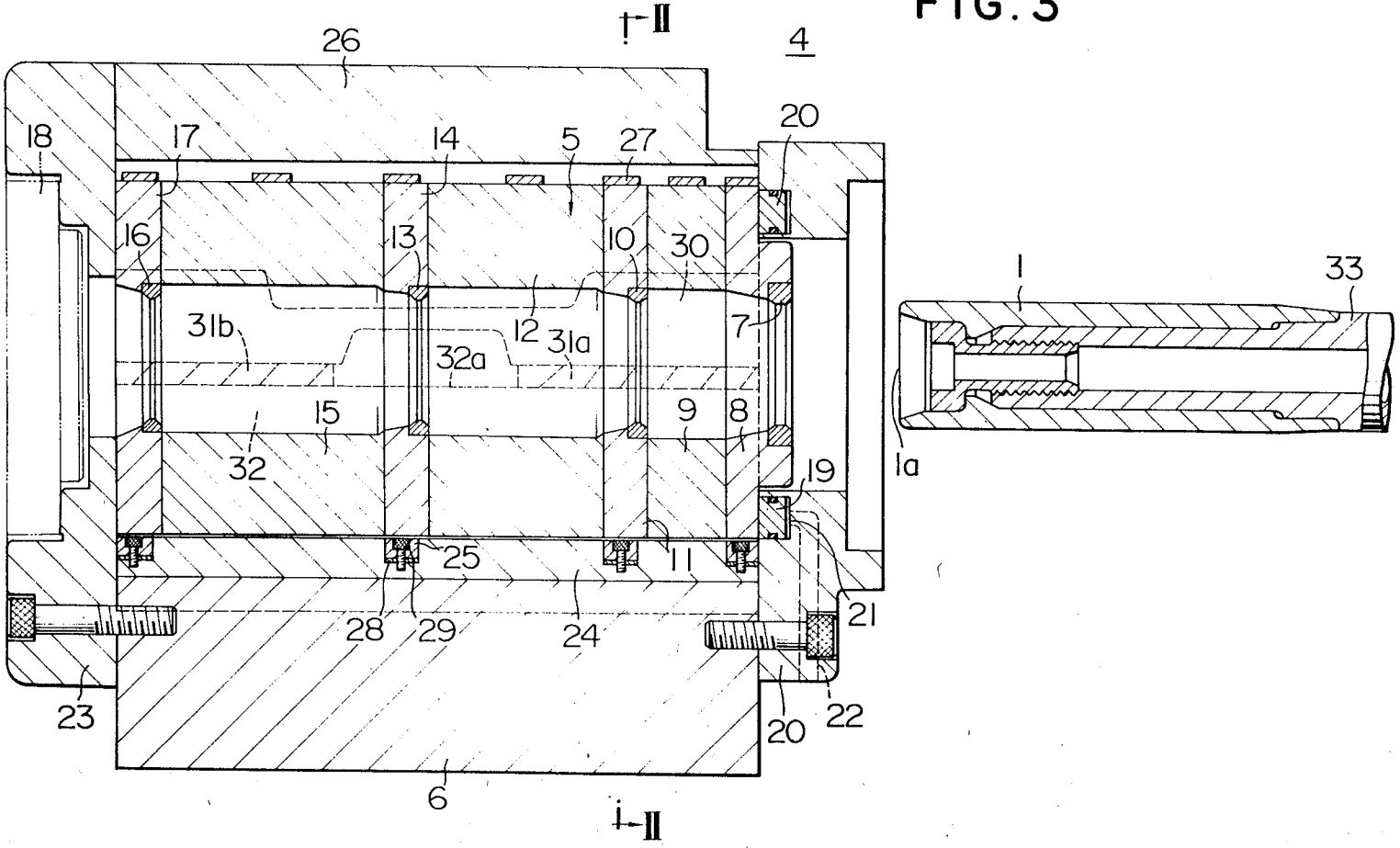
FIG. 3 is a vertical, sectional view taken along line III—III of FIG. 2.

Referring to FIGS. 2 and 3, a die pack 5 of a redrawing-ironing machine 4 is received in a housing 6, and essentially consists of a redrawing die 7, a redrawing die holding ring 8, a first spacer 9, a first ironing ring die 10, a first die holding ring 11, a second spacer 12, a second ironing ring die 13, a second die holding ring 14, a third spacer 15, a third ironing ring die 16 and a third die holding ring 17. The first, second and third die holding rings 11, 14 and 17 are formed to have the same outer diameter with the precision of $\pm 0.5\ \mu m$.

A stripper 18 for stripping an ironed can body off the punch 1 is received in a stripper case 23 which is fixed to the housing 6. An annular piston 19 received in an annular cylinder 21 formed in a cylinder plate 20 which is fixed to the housing 6, is adapted to clamp the die pack 5 by pushing the die pack 5 against the stripper case 23 with a pressurized air supplied through a hole 22 and a conduit not shown.

The first die holding ring 11, in the same manner as the redrawing die holding ring 8, the second die holding ring 14 and the third die holding ring 17, is mounted on two gage blocks 25 placed on two rails 24 fixed to the housing 6, with shims 28 interposed therebetween, and supported at three points by the two gage blocks 25 and a horizontal leaf spring 27 fixed to the underside of a cover 26 hinged to the housing 6, in case where the cover 26 is closed.

In the case of FIG. 2, a line connecting the contact point a between the gage block 25 and the holding ring 11 with the center o of the holding ring 11 is inclined by 45 degrees with respect to the vertical line, that is, $\theta$ is equal to 45 degrees. The shim 28 and the gage block 25 are fixed to the rail 24 with bolts 29, and the height level of the gage block 25 is adjusted by changing the thickness of the shim 28.

Figure 4:
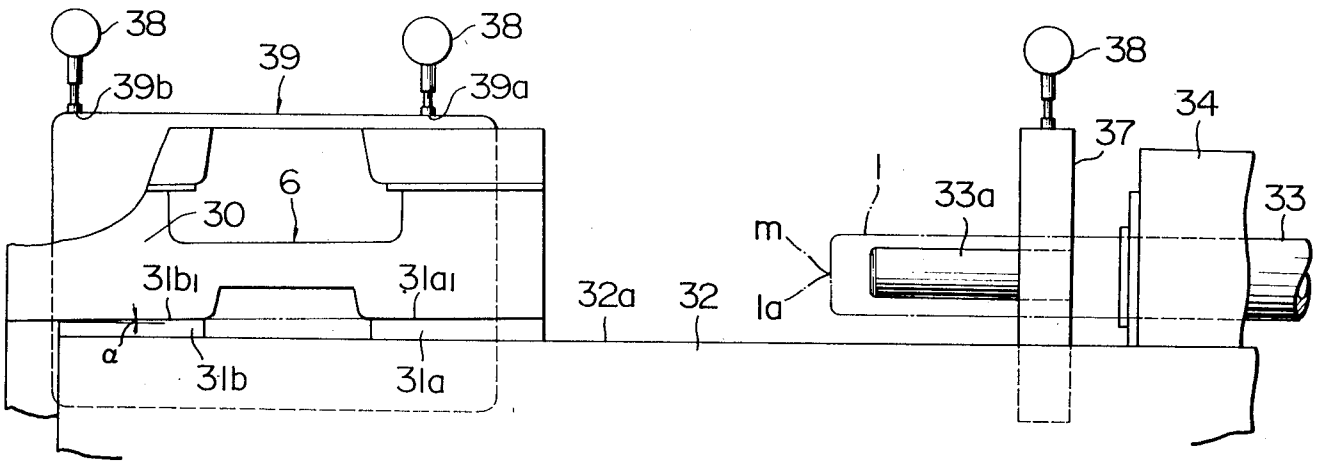
FIG. 4 is an explanatory, front view for indicating an example of a method of adjusting the inclination of the housing in the ironing apparatus shown in FIG. 2.

Holding wings 30 projecting at the front and rear sides of the housing 6 are mounted on upper surfaces 32*a* extending horizontally of a frame 32, with spacers 31*a* and 31*b* interposed therebetween (refer to FIG. 4). The spacers 31*a* and 31*a* are provided to adjust the inclination of the die pack 5 with respect to the horizontal plane, as mentioned hereinafter.

As shown in FIGS. 3 and 4, the punch 1 is fixed to the tip of an elongated ram 33 which is, e.g., 50 mm in diameter and 1.35 m long. The ram 33 is supported by a bearing means 34, and is adapted to reciprocate in the horizontal direction at a high speed, e.g., at 200 strokes per minute by means of a crank drive not shown.

Figure 5:
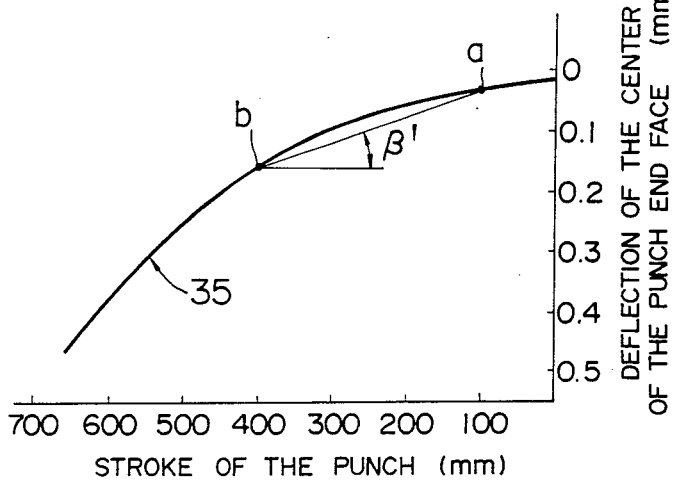
FIG. 5 is a diagram indicating an example of the relationship between the deflection of the end face of the punch and the stroke of the punch in the ironing apparatus of FIG. 2.

Referring to FIG. 5, a curve 35 extending leftwardly, downwardly indicates an example of the relationship between the stroke of the center 1*a* of the punch end face measured, in case of the ram 33 of 50 mm in diameter and 1.35 m long, from a point m in FIG. 4 which shows the farthest retracted position of the center 1*a*, and the downward deflection of the center 1*a* of the punch at a standstill with gravity which has been calculated, since it is very difficult to measure the deflection. A point a and a point b correspond to the axial locations of the first die 10 and the third die 16, respectively. According to the inventor's experience, the center 1*a* may move vibrating in the radial direction with the curve 35 as a virtual center, when the punch 1 reciprocates at a high speed. Accordingly in the specification the curve 35 is designated a locus of the center 1*a* of the punch end face.

Figure 6:
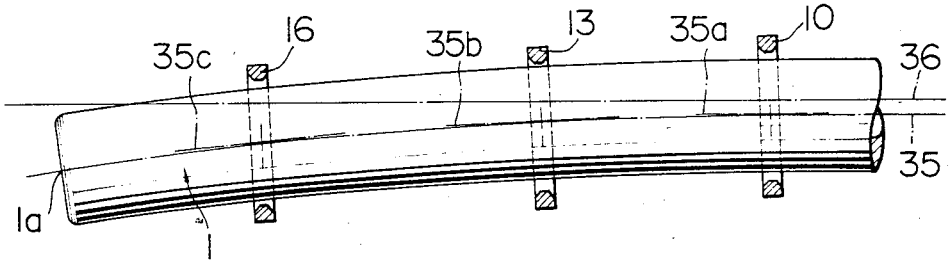
FIG. 6 and FIG. 7 are explanatory, fragmentary, vertical sectional views showing the relationship between the disposition of the die and the locus of the center of the end face of the punch in the ironing apparatus of FIG. 2, before radial alignment and after radial alignment of the die, respectively.

As shown exaggeratedly in FIG. 4, the spacers 31*a* and 31*b* are tapered in the axial direction of the die pack 5 such that they may be slightly thinner at the exit side (the left side of the drawing) than at the entry side, and the upper surface $31b_1$ of the exit side spacer 31*b* be on the same phantom surface with the upper surface $31a_1$ of the entry side spacer 31*a*. When the taper angle $\alpha$ of the spacers 31*a* and 31*b*, that is, an inclination of the upper surfaces $31a_1$ and $31b_1$ with respect to the frame upper surface 32*a* extending horizontally, is adequately preset, e.g., when the angle $\alpha$ is determined to be virtually equal to an angle $\beta$ not shown, corresponding to an angle $\beta'$ shown in FIG. 5, formed between the axis of abscissa and the line connecting the point a and the point b in FIG. 5, in case where the axis of abscissa and the axis of ordinate are represented with the measure of the same magnification, the ironing ring dies 10, 13 and 16 slightly incline with respect to the vertical plane, and the axes of the ring dies 10, 13 and 16 extend substantially in the direction of the tangential lines 35*a*, 35*b* and 35*c* of the locus 35 at the location of the respective die, respectively, as shown in FIG. 6, where reference numeral 36 indicates a horizontal line.

After the housing 6 receiving the die pack 5 has been mounted on the frame 32 via the spacers 31*a* and 35*b* with the appropriate taper angle $\alpha$, the ironing dies 10, 13 and 16 are radially aligned with respect to the punch 1 to reciprocate at a high speed by adjusting the height level of the respective gage block 25 with the respective shim 28 for the respective ironing ring dies 10, 13 and 16, using, e.g., a punch center measuring device such as described in Japanese Laid-Open Publication No. 99706/1983.

Figure 1:
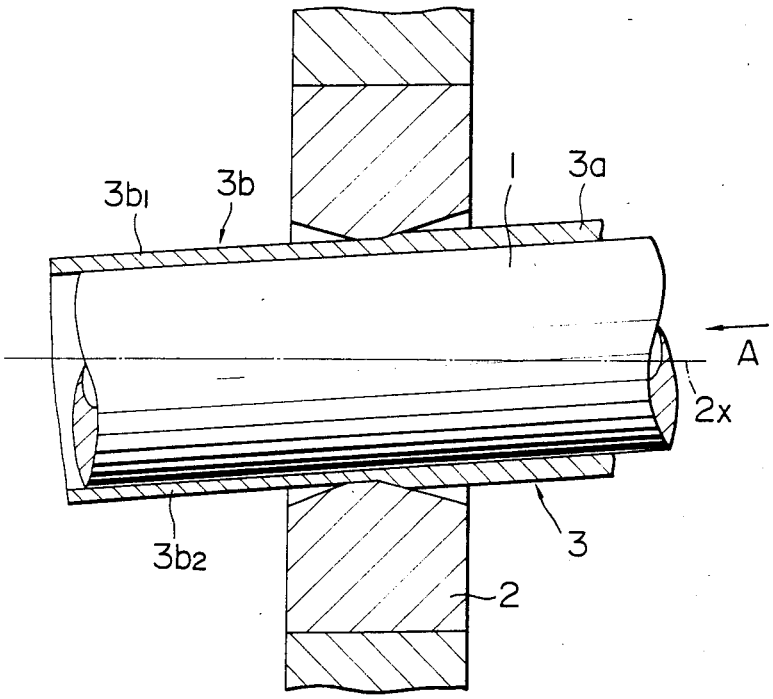
FIG. 1 is an enlarged, fragmentary, vertical, sectional view showing a state in which an ironing operation is carried out with a conventional ironing apparatus.
Figure 7:
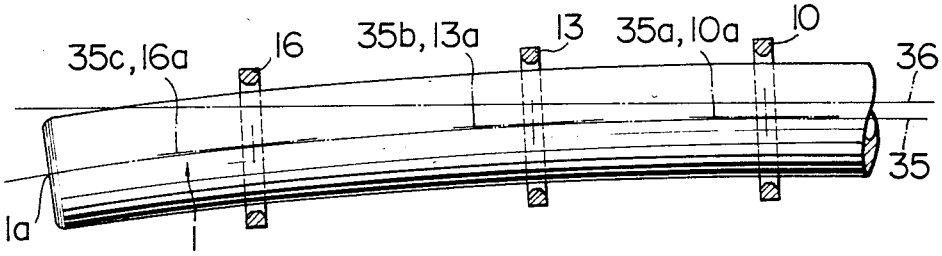

The ironing ring dies 10, 13 and 16 after the aforementioned alignment are illustrated with respect to the punch 1 in FIG. 7, wherein the axes 10*a*, 13*a* and 16*a* of the respective ring dies 10, 13 and 16 virtually coincide with the corresponding tangential lines 35*a*, 35*b* and 35*c*, respectively. When ironing is performed at this state, uneven circumferential thickness of the sidewall portion such as shown in FIG. 1 may be eliminated.

The spacers 31*a* and 31*b* may be installed, e.g. in the following manner: As illustrated in FIG. 4, when the ram 33 is at the farthest retracted position, the punch 1 is removed from the ram 33, and an inspection ring 37 having the same outer diameter as that of the holding rings 11, 14 and 17 is fixed to the base portion of the punch mounting portion 33*a* of the ram 33. Thereafter a dialindicator 38 is abutted on the apex of the inspection ring 37, and the pointer thereof is set to zero.

Subsequently the housing 6 in which an inspection cylinder 39 having the same configuration as the die pack 5 and an outer diameter equal to that of the inspection ring 37 has been mounted on the rails 24 via the gage blocks 25, is installed on the frame 32 with the spacers 31*a* and 31*b* interposed therebetween. The dialindicator 38 whose pointer has been set to zero, is abutted to apexes 39*a* and 39*b* at the axial locations of the inspection cylinder 39 corresponding to those of the first ring die 10 and the third ring die 16, respectively, so as to adjust the inclination of the housing 6 with respect to the horizontal plane. The adjustment is made by selecting and installing the spacers 31*a* and 31*b* having such a thickness and a taper angle $\alpha$ that may allow the indications in mm of the pointer at the apexes 39*a* and 39*b* to be same as the deflections in mm at the points a and b in FIG. 5, respectively. Thereafter the inspection cylinder 39 is removed, and the die pack 5 is mounted on the housing 6.

What is claimed is:

1. An ironing apparatus for forming a cup-like metallic article which comprises: a punch provided on a tip of a ram adapted to reciprocate in the horizontal direction and a plurality of ring dies cooperating with the punch, in which the punch reciprocates such that the center of the end face thereof moves along a locus curved downwardly with the gravity, and the die is disposed to be slightly inclined with respect to a vertical plane such that the axis of the die extends substantially in the tangential direction of the locus at the location of the die.

2. An ironing apparatus according to claim 1, wherein the cup-like metallic article is an one-piece metallic can body.

* * * * *